US006096466A

United States Patent [19]

Imai et al.

[11] Patent Number: 6,096,466

[45] Date of Patent: Aug. 1, 2000

[54] DEVELOPER AND DEVELOPING METHOD

[75] Inventors: Takashi Imai; Akihiro Iizuka; Yoshifumi Iida; Masanori Ichimura, all of Ashigara, Japan

[73] Assignee: Fuji Xerox Co., Ltd., Tokyo, Japan

[21] Appl. No.: 09/244,127

[22] Filed: Feb. 4, 1999

[30] Foreign Application Priority Data

Feb. 5, 1998 [JP] Japan ..... 10-024612

[51] Int. Cl.[7] ..... G03G 15/08

[52] U.S. Cl. ..... 430/108; 430/120; 399/260

[58] Field of Search ..... 430/108, 120; 399/260

[56] References Cited

U.S. PATENT DOCUMENTS

| | | | |
|---|---|---|---|
| 5,672,455 | 9/1997 | Kanagida et al. | 430/120 |
| 5,771,426 | 6/1998 | Oka et al. | 399/260 |
| 5,771,429 | 6/1998 | Oyama et al. | 399/260 |

FOREIGN PATENT DOCUMENTS

| | | |
|---|---|---|
| B2-2-21591 | 5/1990 | Japan . |
| 3-145678 | 6/1991 | Japan . |
| 8-234550 | 9/1996 | Japan . |

*Primary Examiner*—John Goodrow
*Attorney, Agent, or Firm*—Oliff & Berridge, PLC

[57] ABSTRACT

A developer for replenishment for use in a developing system in which a latent image on a latent image holding member is developed with a developing unit containing a two-component developer comprising a toner and a carrier while replenishing the developer with a developer for replenishment, the developer for replenishment comprising a carrier and from 1 to 30 parts by weight of a toner per 1 part by weight of the carrier, and the developer for replenishment having an electrical resistance substantially equal to that of the carrier previously contained in the developing unit, but giving a larger charge quantity to the toner than the carrier previously contained in the developing unit does. Also disclosed is a developing method using the developer for replenishment.

17 Claims, 3 Drawing Sheets

DEVELOPER AND DEVELOPING METHOD

FIELD OF THE INVENTION

This invention relates to a developer and a developing method for visualizing an electrostatic latent image in electrophotography and electrostatic recording.

BACKGROUND OF THE INVENTION

In the currently leading developing method using a two-component dry developer comprising a toner and a carrier, the toner is consumed by development whereas the carrier is not consumed and remains in a development unit. As a result, a toner component adheres to the carrier particles to contaminate the carrier. Further, the carrier itself is under the stress of collision in the developing unit. As a result, the resin coat eventually comes off the carrier particles to influence the developer characteristics such as chargeability. This causes a fluctuation in the toner image density or causes generation of fog.

So-called trickle type developing equipment has been proposed to solve the above problem as disclosed in JP-B-2-21591, in which a carrier trickles into the development unit together with a toner that is to be consumed for development to slowly exchange the carrier in the developing unit for a fresh one, to thereby suppress the variation in charge quantity and to stabilize the image density. However, since the trickling carrier is the same as that previously contained in the developing unit, the deteriorated carrier increases while development operation is repeated, resulting in a failure to suppress the variation of image density.

JP-A-3-145678 proposes use of a toner in combination with a carrier having a higher resistivity than the carrier previously present in a developing unit to thereby maintain chargeability and suppress reduction in image quality. According to this technique, however, the amount of the carrier to be fed changes according to the amount of the toner consumed so that the resistance of the developer in the developing unit varies, resulting in variation of image density.

JP-A-8-234550 discloses a method in which a plurality of toners for replenishment which contain a carrier having different physical properties from those of the carrier previously contained in the developing unit are fed successively. However, because the carrier and the toner differ extremely in specific gravity, it is practically very difficult to replenish the developing unit successively with the replenishing toners using a single feed container while avoiding mixing up of the replenishing toners. In addition, the carrier is liable to deterioration due to the large proportion of the toner over the carrier, resulting in a failure to obtain a stable image over an extended period of time.

SUMMARY OF THE INVENTION

The present invention has been accomplished to solve various problems as described above.

An object of the present invention is to provide a developer for replenishment for use in a trickle type developing apparatus, which produces a stable image throughout the life of the developer.

Another object of the invention is to provide a developing method using the developer for replenishment.

Other objects and effects of the present invention will become apparent from the following description.

The inventors of the invention have studied a two-component developer which exhibits satisfactory performance in a trickle type developing apparatus. As a result, they have found that the above objects of the invention are accomplished by using a toner for replenishment containing a carrier which is substantially equal in electrical resistance to the carrier contained in the developing unit but produces a larger charge quantity than the carrier contained in the developing unit does. The present invention has been completed based on this finding.

That is, the above-described objects of the present invention have been achieved by providing a developer for replenishment for use in a developing system in which a latent image on a latent image holding member is developed with a developing unit containing a two-component developer comprising a toner and a carrier while replenishing the developer with a developer for replenishment, the developer for replenishment comprising a carrier and from 1 to 30 parts by weight of a toner per 1 part by weight of the carrier, and the developer for replenishment having an electrical resistance substantially equal to that of the carrier previously contained in the developing unit, but giving a larger charge quantity to the toner than the carrier previously contained in the developing unit does.

In a preferred embodiment of the invention, the carrier of the developer for replenishment has a resin coat which comprises the same kinds of materials as used for the resin coat of the carrier previously contained in the developing unit, but is different therefrom in composition.

The present invention also relates to a developing method comprising:

developing a latent image on a latent image holding member using a developing unit containing a two-component developer comprising a toner and a carrier while replenishing the developer with a developer for replenishment, wherein the developer for replenishment comprises a carrier and from 1 to 30 parts by weight of a toner per 1 part by weight of the carrier, and wherein the developer for replenishment has an electrical resistance substantially equal to that of the carrier previously contained in the developing unit, but gives a larger charge quantity to the toner than the carrier previously contained in the developing unit does.

The terminology "electrical resistance" or, more simply, "resistance" as used herein for a carrier means a volume resistivity (Ω·cm) obtained by separating a carrier from a developer by blowing off a toner, making the carrier into a 500 μm thick layer, and measuring the volume resistivity in an electric field of 1000 V. The terminology "charge quantity" as used herein means a charge quantity (μC/g) measured on a developer comprising 100 parts by weight of a carrier and 8 parts by weight of a toner by a blow-off method.

DETAILED DESCRIPTION OF THE INVENTION

Figure 1:
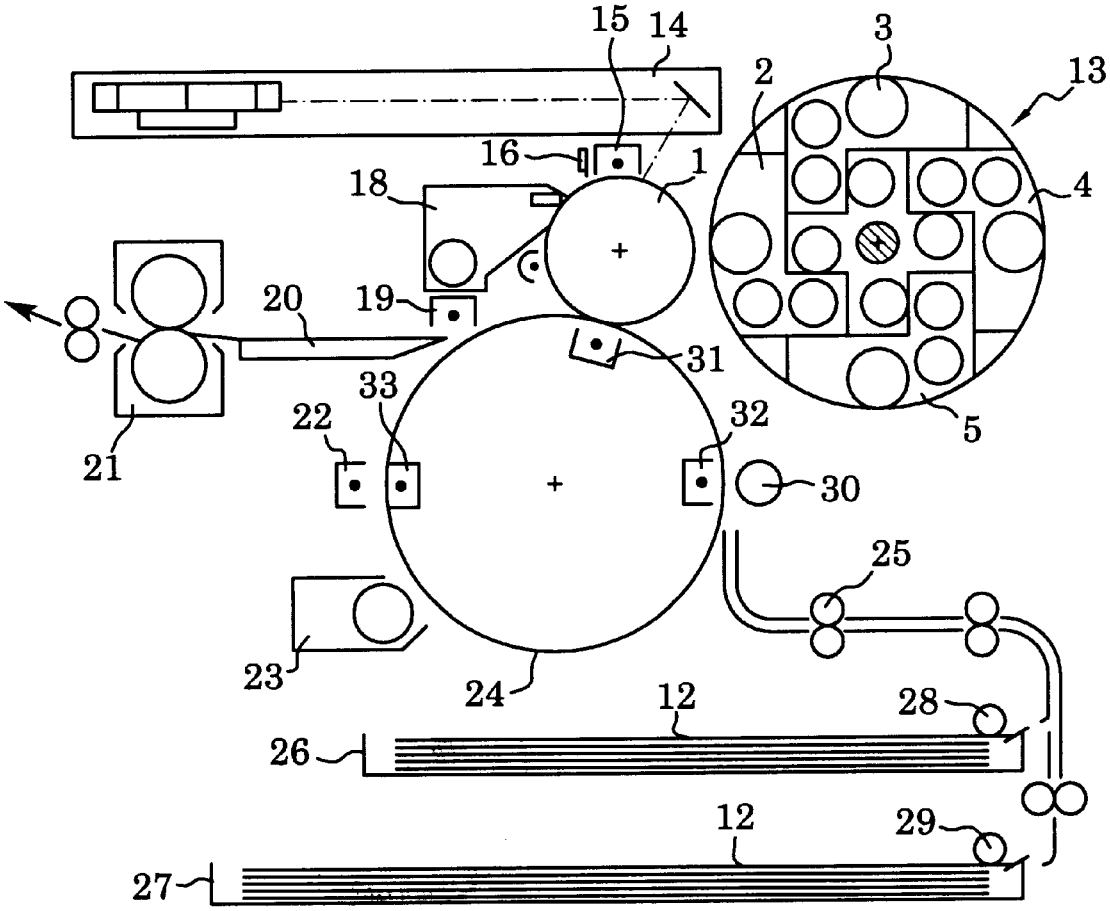
FIG. 1 is a schematic view of a full color image forming apparatus having a rotary developing unit in which the developer for replenishment of the invention is used.

The present invention is described in more detail below.

The carrier for use in the invention is preferably a coated carrier comprising magnetic particles, such as ferrite, magnetite or iron powder, coated with a resin coating material. A preferred average particle size of the magnetic particles is from 10 to 50 μm. Magnetic particles greater than 50 μm tend to suffer fall-off of the resin coat due to the stress within a developing unit, resulting in reduction of carrier resistance. Particles smaller than 10 μm tend to cause toner impaction, resulting in increase of carrier resistance. These unfavorable phenomena are considered to be attributed to the weight of the carrier per particle. The magnetic particles preferably have a saturation magnetization of 50 emu/g or greater, more preferably 60 emu/g or greater, in a magnetic field of 3000 Oe. If the saturation magnetization is less than 50 emu/g, the carrier would be transferred onto the latent image holding member together with the toner.

The coating material forming the resin coat comprises a charging resin for affording charges to the toner and a low surface energy material for preventing migration of a toner component to the carrier and, if desired, electrically conductive powder for controlling the resistance of the resin coat. The charging resin which gives negative charges to the toner includes amino resins, such as a urea-formaldehyde resin, a melamine resin, a urea resin, and a benzoguanamine resin; polyamide resins, and epoxy resins. In addition, polyvinyl resins, polyvinylidene resins, acrylic resins, polymethyl methacrylate resins, polyacrylonitrile resins, polyvinyl acetate resins, polyvinyl alcohol resins, polyvinyl butyral resins, and cellulosic resins (e.g., ethyl cellulose resin) are also useful. The charging resin which gives positive charges to the toner includes styrene resins, such as polystyrene and styrene-acrylic copolymer resins; halogenated olefin resins, such as polyvinyl chloride; polyester resins, such as polyethylene terephthalate and polybutylene terephthalate; and polycarbonate resins.

The low surface energy material which is used to prevent a toner component from migrating to the carrier includes styrene resins, ethylene resins, polyvinyl fluoride resins, polyvinylidene fluoride resins, polytrifluoroethylene resins, polyhexafluoropropylene resins, vinylidene fluoride-acrylic monomer copolymer resins, vinylidene fluoride-vinyl fluoride copolymer resins, fluoro-terpolymers such as a tetrafluoroethylene-vinylidene fluoride-non-fluorine monomer copolymer, and silicone resins.

The electrically conductive powder includes metal powder, carbon black, and powder of a metal oxide such as titanium oxide, tin oxide and zinc oxide. The powder preferably has an average particle size of not greater than 1 μm. Particles greater than 1 μm make resistance control difficult. If desired, conductive resin particles can be used.

It is essential for the carrier of the developer for replenishment be substantially equal in electrical resistance to the carrier previously contained in the developing unit and be capable of giving a larger charge quantity to the toner than the previously contained carrier does. The language "substantially equal in electrical resistance" as used herein denotes that the difference in the degree between the volume resistivity (Ω·cm) of the carrier for replenishment and that of the carrier previously contained in the developing unit is within two, preferably within one. It is preferred for the carrier for replenishment to give the toner a larger charge quantity than the carrier in the developing unit by 2 to 15 μC/g. In order for the carrier to have such higher charging properties, it is necessary for the carrier particle to have the same magnetic particle as used in the carrier previously contained in the developing unit and to have a resin coat comprising the above-mentioned charging resin and low surface energy material and having the same coating weight (weight ratio of the coat layer to the magnetic particle). It is also necessary that the proportion of the charging resin to the total amount of the charging resin and the low surface energy material in the resin coat of the carrier for replenishment be higher than that in the resin coat of the carrier previously contained in the developing unit. The larger charge quantity can also be produced by using a different charging resin from the charging resin of the coated carrier previously contained in the developing unit. The conductive powder, which is used to control the electrical resistance of the resin coat, can be used in the same amount as that used in the carrier previously contained in the developing unit.

The two resins, i.e., the charging resin and the low surface energy material, may dissolve in each other. Where incompatible to each other, they may form a phase separation structure, or the charging resin may be finely dispersed in the low surface energy material.

The resin coat can be formed on the magnetic particles by using a solution of the coating film-forming raw materials, such as the charging resin, the low surface energy material, the conductive powder, etc. For example, the solution is sprayed onto the magnetic particles, followed by solvent removal (spray-dry method), or the magnetic particles and the solution are mixed in a kneader coater, followed by solvent removal (kneader coater method).

The carrier for replenishment can be used in combination with any kind of toners to provide a developer for replenishment. It is particularly useful in providing a full color developer for replenishment.

It is required for the developer for replenishment according to the present invention to contain 1 to 30 parts by weight, preferably 3 to 20 parts by weight, of a toner per part by weight of the carrier. If the proportion of the toner exceeds 30 parts, such an extremely large quantity of the toner will deteriorate the carrier, and the developer tends to decrease in charge quantity. If the proportion of the toner is less than 1 part, the excessive carrier tends to cause the developer to have increased charge quantity, which can result in variation of image density.

The toner mainly comprises a binder resin and a colorant. Useful binder resins include polystyrene, a styrene-alkyl acrylate copolymer, a styrene-alkyl methacrylate copolymer, a styrene-acrylonitrile copolymer, a styrene-butadiene copolymer, a styrene-maleic anhydride copolymer, polyethylene, and polypropylene. Polyester, polyurethane, epoxy resins, silicone resins, polyamide, modified rosin, paraffin wax, etc. are also employable.

Useful colorants include carbon black, Nigrosine, Aniline Blue, Chalcoyl Blue, Chrome Yellow, Ultramarine Blue, Du Pont Oil Red, Quinoline Yellow, Methylene Blue chloride, Phthalocyanine Blue, Malachite Green oxalate, lamp black, Rose Bengale, C.I. Pigment Red 48:1, C.I. Pigment Red 122, C.I. Pigment Red 57:1, C.I. Pigment Yellow 97, C.I. Pigment Yellow 180, C.I. Pigment Yellow 12, C.I. Pigment Blue 15:1, and C.I. Pigment Blue 15:3.

If desired, the toner of the invention can further contain a charge control agent, a cleaning aid, and the like. Further, the developer of the invention can further contain external additives such as inorganic oxides and organic fine particles.

An image forming apparatus having a developing unit in which the developer for replenishment according to the invention is to be used will be illustrated with reference to FIGS. 1 through 4.

FIG. 1 schematically shows an electrophotographic full color image forming apparatus on which a rotary developing unit is mounted. In the apparatus, a latent image holding member 1 is uniformly charged negatively on its surface by a uniform charger 15. Then an original is exposed to light for a first color image, e.g., a black image by means of a laser exposing unit 14 to form an electrostatic latent image corresponding to the black image on the surface of the latent image holding member 1.

The rotary developing unit 13 rotates to bring its black developing part to the position facing the latent image holding member 1 before the leading end of the latent image corresponding to the black image reaches the position for development, and a magnetic brush brushes the latent image to form a black toner image on the latent image holding member 1.

The developing unit 13 is divided into developing parts 2, 3, 4 and 5 for each color development. Each developing part contains, for example, a developing sleeve, a feed roll, a magnetic roll, a regulating member, a scraper, etc.

Figure 2:
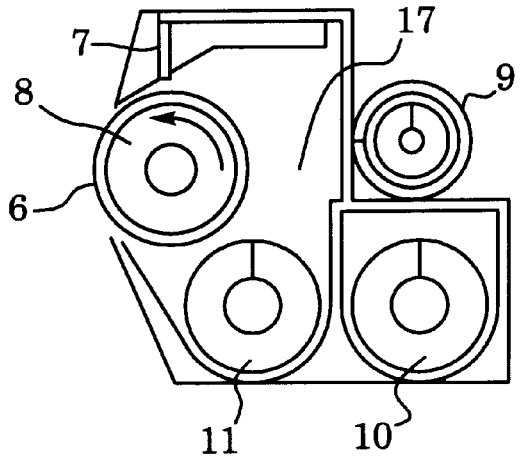
FIG. 2 is a schematic view of a developing part of the developing unit shown in FIG. 1.

The flow of the developer in the developing unit 13 is explained by referring to FIG. 2. A developing sleeve 6 has a magnet roll 8 fixed therein and rotates with a given clearance from the surface of the latent image holding member 1. In some cases the developing sleeve 6 is in contact with the latent image holding member 1. The magnet roll 8 includes one made up of magnets of equal magnetic force with the north poles and the south poles spaced alternately at regular intervals to give 8 poles in total and one having the same magnet arrangement except that one pole is missing so as to form a repellent magnetic field at the part in contact with a scraper to help the developer release. A regulating member 7 is rigid and magnetic. The regulating member 7 includes various types such as one which is pressed onto the developing sleeve 6 under a prescribed load with no developer present therebetween and one which is set at a prescribed clearance from the developing sleeve 6. A pair of members (agitating and transfer members) 10 and 11 have a screw structure and rotate in opposite directions to sufficiently mix up a toner and a carrier and transfer the developer to the developing sleeve 6.

The agitating and transfer members 10 and 11 are members which rotate in opposite directions and combine the function as an agitating member. By the thrust force of the screws, the members 10 and 11 transfer the developer for reinforcement supplied from a developer container 9 while agitating the toner and the magnetic carrier to make a triboelectrically charged homogeneous two-component developer, which is attracted on the surface of the developing sleeve 6 in a layer. The developer on the developing sleeve 6 is regulated by the regulating member 7 having a double structure comprising a non-magnetic material and a magnetic material arranged to face the magnetic poles of the magnet roll 8, to form a uniform developer layer. The developer layer thus regulated is transferred to the latent image on the latent image holding member 1 to form a toner image thereon.

In FIG. 1 a transfer material 12 (paper or a transparent sheet) is fed from a paper feed cassette 26 or 27 by a feed roll 28 or 29. The leading end reaching a registration roll 25, the transfer material is once stopped for timing and then forwarded to a transfer drum 24. While being held on the transfer drum 24 electrostatically by an absorber unit 32 and a counter roll 30, the transfer material 12 is carried to a transfer zone where the transfer drum 24 and the latent image holding member 1 face to each other, where the transfer material is brought into contact with the black toner image on the latent image holding member 1. The black toner image is thus transferred to the transfer material 12 by the action of a transfer unit 31, and the transfer drum 24 stands ready for the next color image formation while holding the transfer material 12 on.

The latent image holding member 1 from which the black toner image has been released is destaticized by a destaticizing corotron, and the black toner remaining on the surface is scraped off with a cleaner 18. If desired, the latent image holding member 1 is subjected to a pre-cleaning treatment prior to the destaticization with the corotron. Any residual charges on the surface are then eliminated by a destaticizer 16.

Then, the surface of the latent image holding member 1 is negatively charged uniformly to get ready for formation of an electrostatic latent image of a next color, for example, a yellow color. The latent image holding member 1 is image-wise exposed for a yellow image to form an electrostatic latent image on its surface. By that time, the developing unit 13 has rotated to revolve its yellow developing part to the position facing to the latent image holding member 1. The latent image corresponding to the yellow image is developed with a magnetic brush for yellow. The transfer material 12 held on the transfer drum 24 has been moved to the transfer zone, where the yellow toner is superposed on the black toner image of the transfer material 12 by the action of the transfer unit 31.

After transfer of the yellow toner image, the latent image holding member 1 is cleared of the residual yellow toner and destaticized in the same manner as described above. On the other hand the transfer material 12 having the black and yellow toner image stands for the subsequent color image formation while held on the transfer drum 24.

In the same manner, a third color image, e.g., a magenta image, is formed on the transfer material 12. Finally, a fourth color image, e.g., a cyan image, is formed in the same manner as described above, except that the resulting transfer material having a full color image formed thereon is released from the transfer drum 24 by a release finger (not shown) provided in front of a destaticizer 19 for paper release and a transfer guide 20 and sent to a fixing unit 21, where the full color toner image is fixed on the transfer material 12 and discharged out of the apparatus.

The transfer drum 24 from which the transfer material 12 has been separated is then destaticized by destaticizer 22 and cleaned by a cleaner 23 to get ready for receiving the next transfer material 12.

While the above-described cycle of full color image formation is repeated, the toner of the developer in a developing tank 17 is gradually consumed to decrease the toner to carrier ratio, i.e., the toner concentration. The decrease of toner concentration is monitored by a toner concentration sensor (not shown) provided in the developing tank 17 and fed back to a control system so that the toner concentration may always fall within a proper range required for development. By this feedback control the developer for replenishment is supplied from the developer container 9 to the developing tank 17.

On the other hand, the carrier of the developer in the developing tank 17 is not consumed for development and gradually undergoes deterioration while agitated with the toner in the developing tank 17 or influenced by the magnetic force of the magnet roll 8 and the contact with the latent image holding member 1. As a result of the deterioration, the carrier fails to give a desired charge quantity to the toner, which results in reduction of image quality. Therefore there is necessity to replace the deteriorated carrier with a fresh carrier. As a means for replenishing the developing tank 17 with a fresh carrier, a developer for replenishment prepared by mixing the toner for replenishment and a requisite amount of the above-described carrier is put in a toner cartridge (developer container 9) and supplied to each of the developing parts 2, 3, 4 and 5. An excess of the developer is discharged from an outlet 34 of each developing part as described blow.

Figure 3:
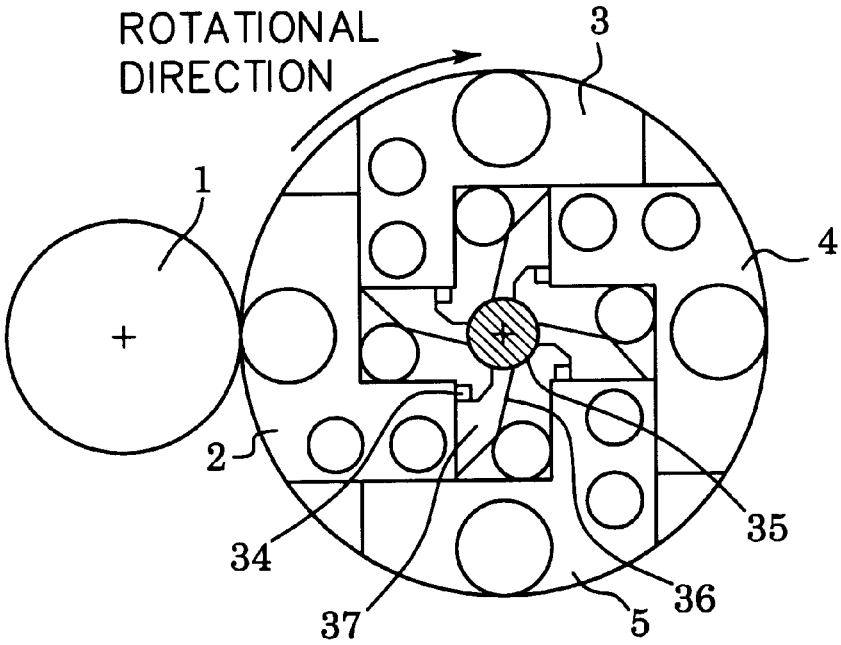
FIG. 3 is an enlarged view of the developing unit shown in FIG. 1.

Replenishment of the developer can be effected by taking advantage of the rotation of the developing unit 13 as follows. FIG. 3 is referred to. The developing part 2, 3, 4 or 5 revolves on the axis of the developing unit 13 to the position where it faces to the latent image holding member 1 when it is to serve for development and to the position where it does not face to the latent image holding member when it does not participate in development.

FIG. 3 shows the state in which the developing part 2 faces to the latent image holding member 1 to carry out development. At this position, the developer flowing over the outlet 34 is temporarily accumulated in a reserving part 37 of a duct 36 which connects the outlet 34 and a discharge port 35 provided on the axis of rotation of the developing unit 13. The capacity of the reserving part 37 should be fairly larger than the amount of the developer that would be discharged if development is continuously carried out in a monochromatic mode, i.e., without rotation of the developing unit 13.

Figure 4:
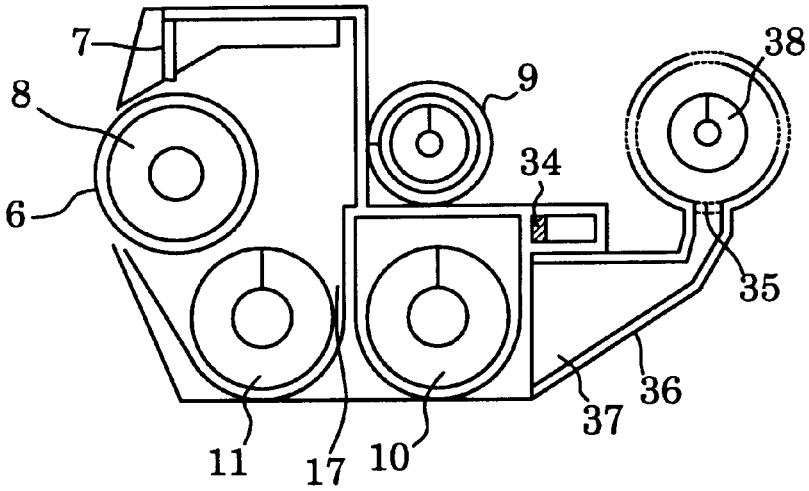
FIG. 4 is an enlarged view of the developing part of the developing unit shown in FIG. 3.

On completion of the development with the developing part 2, the developing unit 2 rotates in the direction indicated by the arrow by an angle of 45°, i.e., to the position where the developing part 3 has been. With this rotation the developer in the reserving part 37 moves toward the discharge port 35 and discharged therefrom. In more detail, as shown in FIG. 4, an auger 38 is provided at the center of the axis of rotation so that the developer discharged from the discharge port 35 is carried through the axis along the auger 38 and finally discharged out of the system. On further continuation of development, the developing part 2 moves to the position where the developing part 4 has been so that the duct 36 is completely evacuated.

When a developing part is at the positions of the developing parts 2 and 5 as illustrated in FIG. 4, there is a possibility that the once discharged developer may flow back to the duct 36 through the discharge port 35. However, the developer which may flow back through the discharge port 35 can reach the reserving part 37 of the duct 36 but never enters the developing part. Even if the developer once discharged from the developing part 2 flows back to its reserving part 37, it is again discharged through the discharge port 35 when the developing part reaches the position of the developing part 3 as illustrated in FIG. 3. Therefore, it does not mix with the developer in the developing part which participates in development, giving no adverse influences to the image quality and the life of the developer.

As shown in FIG. 4, the duct 36 preferably has a trumpet shape which is widest under the outlet 34 to make the reserving part 37 so that the developer discharged from the outlet 34 may be accumulated and also the developer once discharged from the discharge port 35, even if it flows back, may be prevented from entering the developing part. The duct 36 preferably has a slope so that the developer accumulated in the reserving part 37 may slide down smoothly toward the discharge port 35 when the developing part moves up by an angle of 45° to the position of the developing part 3 of FIG. 3. In order to prevent the developer having flown back to the duct 36 from entering the developing part, it is desirable that the angle formed between the plane of the outlet 34 and that of the discharge port 35 be about 90°.

The present invention will be described in greater detail with reference to the following Examples, but the invention should not be construed as being limited thereto.

EXAMPLE 1

| 1. Preparation of Toner | |
|---|---|
| Linear polyester resin (terephthalic acid/bisphenol A-ethylene oxide adduct/cyclohexanedimethanol copolymer; Tg: 65° C.; Mn: 5000; MW: 30000) | 100 part |
| Magenta pigment (C.I. Pigment Red 57:1) | 4 parts |

The above binder resin and colorant were kneaded in an extruder, ground in a jet mill, and classified in an air classifier to obtain color particles having a volume average particle size of 7 μm. The particles were mixed with 0.5 part of silica (R972, produced by Nippon Aerosil K.K.) in a Henschel mixer to prepare a magenta toner.

| 2. Preparation of Developer (to be put in a developing part previously) | |
|---|---|
| Ferrite particles (Cu—Zu ferrite; average particle size: 35 μm; saturation magnetization (in 3000 Oe): 70 emu/g) | 100 parts |
| Toluene | 20 parts |
| Perfluorooctylethyl acrylate/methyl methacrylate copolymer (40:60; Mn: 13000; Mw: 45000) | 3.2 parts |
| Carbon black (VXC72, produced by Cabot; average particle size: 30 nm;) | 0.24 part |
| Crosslinked melamine resin (average particle size: 0.3 μm) | 0.6 part |

The above components except the ferrite particles were dispersed in a stirrer to prepare a coating solution. The coating solution and the ferrite particles were stirred in a kneader of vacuum deairing type at 60° C. for 30 minutes, and the solvent was removed to obtain a resin-coated carrier.

A hundred parts of the carrier were mixed with 8 parts of the magenta toner in a twin-cylinder mixer to prepare a developer that was to be put in a developing part previously. The developer was found to have a chargeability of −25 μC/g, and the resistance of the carrier was $1.5\times10^{9}$ Ω·cm.

3. Preparation of Developer for Replenishment

A carrier for replenishment was prepared in the same manner as described above, except for changing the amounts of the crosslinked melamine resin (charging resin) and perfluorooctylethyl acrylate-methyl methacrylate copolymer to 1.0 part and 2.8 parts, respectively.

A hundred parts of the resulting carrier and 8 parts of the magenta toner were mixed in a twin-cylinder mixer. The resulting developer was found to have a chargeability of −30

μC/g, and the carrier was found to have a resistance of $1.0\times10^9$ Ω·cm.

One part of the carrier for replenishment and 10 parts of the magenta toner were mixed up to prepare a developer for replenishment.

COMPARATIVE EXAMPLE 1

A carrier for replenishment was prepared in the same manner as in Example 1, except for using no carbon black. When 8 parts of the same magenta toner as used in Example 1 were mixed per 100 parts of the carrier in a twin-cylinder mixer, the chargeability of the resulting developer was −30 μC/g, and the resistance of the carrier was $2.0\times10^{15}$ Ω·cm.

A developer for replenishment was prepared by using the carrier in the same manner as in Example 1.

Figure 5:
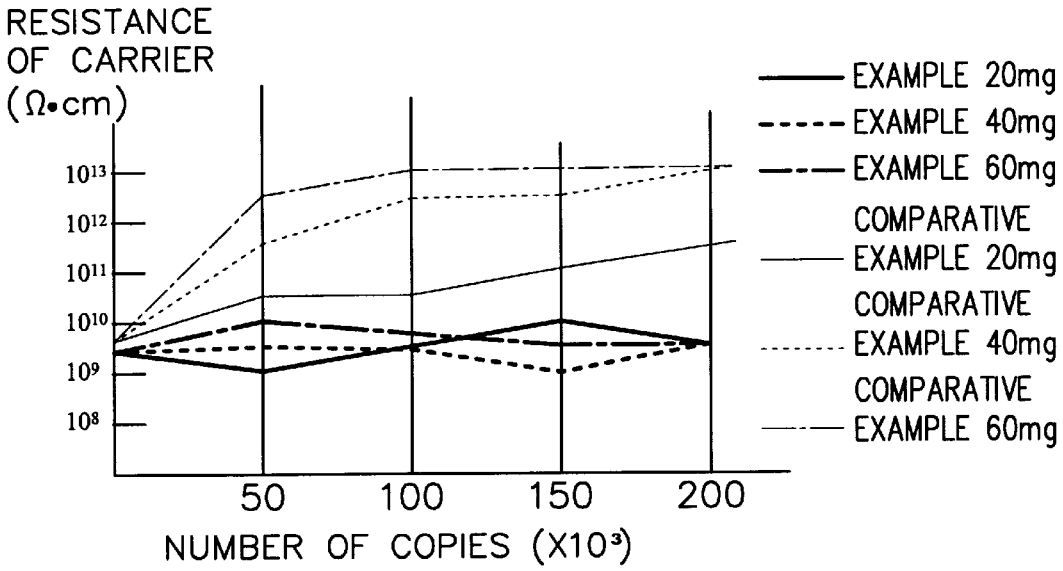
FIG. 5 is a graph showing variation of the resistance of a carrier with the number of copies.
Figure 6:
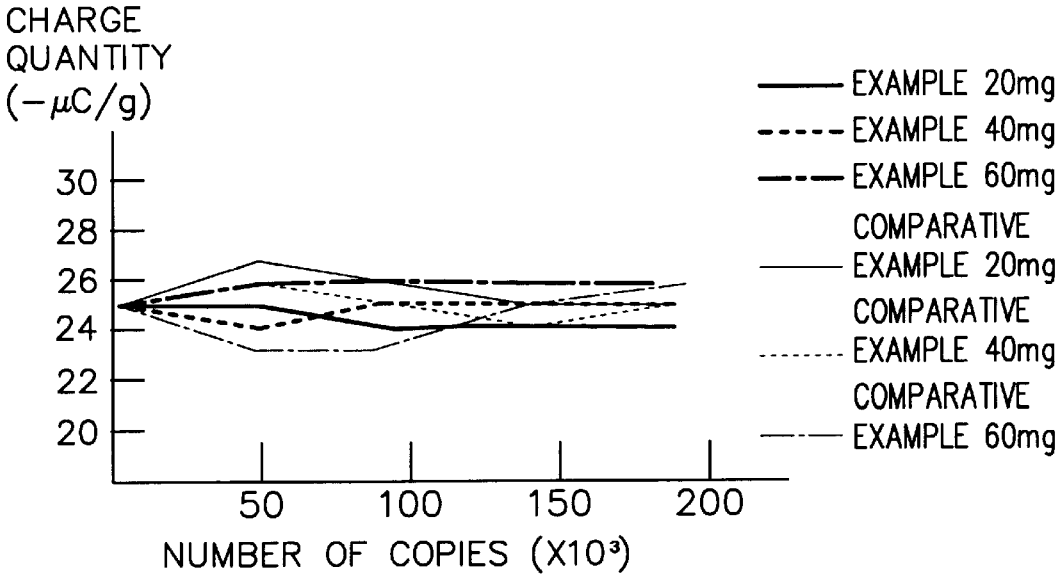
FIG. 6 is a graph showing variation of charge quantity with the number of copies.

A copying test was carried out with the image forming apparatus shown in FIG. 1. The developer to be previously put in a developing part prepared in Example 1 was put in two out of the four developing parts of the developing unit 13. The developer for replenishment prepared in Example 1 and that prepared in Comparative Example 1 were put in the respective toner cartridges (developer containers 9), and the toner cartridges were set on the developing parts. The developing unit 13 was switched over between the two developing parts for every 10 copies. The copying test was repeated for three originals which required 20 mg, 40 mg and 60 mg of the toner, respectively, per copy of A4 size. Variations of the resistance of the carrier (measured on the carrier obtained by blowing off the toner from the developer) and of charge quantity of the developer during the running test are shown in FIGS. 5 and 6, respectively. As is apparent from the Figures, the replenishment system of Example 1 maintained stable copying performance with little change of carrier resistance and charge quantity. To the contrary, the replenishment system of Comparative Example 1, while stable in charge quantity, shows an increase in carrier resistance with running, resulting in reduction of the image density.

COMPARATIVE EXAMPLE 2

A toner and a developer to be put previously in a developing part were prepared in the same manner as in Example 1. A developer for replenishment was prepared in the same manner as in Example 1, except for changing the carrier to toner mixing ratio to 1:40 by weight. As a result of the same copying test as in Example 1, the advantages of a trickle type developing system cannot be brought out on account of the extremely small amount of the carrier fed to the developing part, and the electrical resistance and the charge quantity decreased to cause fog after obtaining about 50,000 copies.

COMPARATIVE EXAMPLE 3

A toner and a developer to be put previously in a developing part were prepared in the same manner as in Example 1. A developer for replenishment was prepared in the same manner as in Example 1, except for changing the carrier to toner mixing ratio to 1:0.5 by weight. As a result of the same copying test as in Example 1, the toner concentration in the developer in the developing part decreased because of the small amount of the toner fed to the developing part. The developer failed to afford an image density after producing about 2,000 copies.

EXAMPLE 2

A toner and a developer to be put previously in a developing part were prepared in the same manner as in Example 1. Two developers for replenishment were prepared in the same manner as in Example 1, except for changing the carrier to toner mixing ratio to 1:3 and 1:25 by weight. As a result of the same copying test as in Example 1, both the developers exhibited equal performance to the developer of Example 1 in terms of variations of carrier resistance and charge quantity with the number of the copies and secured satisfactory image quality for a long period of time.

The developer for replenishment according to the present invention secures stable image formation with a trickle type developing apparatus over the life of the developer.

While the invention has been described in detail and with reference to specific examples thereof, it will be apparent to one skilled in the art that various changes and modifications can be made therein without departing from the spirit and scope thereof.

What is claimed is:

1. A developer system comprising a first developer and a second developer for use in a developing system in which a latent image on a latent image holding member is developed with a developing unit containing said first developer while replenishing said first developer with a second developer, said first developer comprising a first toner and a first carrier;

said second developer comprising a second carrier and from 1 to 30 parts by weight of a second toner per 1 part by weight of said second carrier, and said second developer having an electrical resistance substantially equal to that of said first carrier previously contained in the developing unit, but giving a larger charge quantity to said first toner than does said first carrier previously contained in the developing unit.

2. The developer system according to claim 1, wherein said second carrier is a coated carrier comprising magnetic particles coated with a resin coating material.

3. The developer system for replenishment according to claim 2, wherein said magnetic particles have an average particle size of from 10 to 50 μm.

4. The developer system according to claim 2, wherein said magnetic particles have a saturation magnetization in a magnetic field of 3000 Oe of not less than 50 emu/g.

5. The developer system according to claim 4, wherein said magnetic particles have a saturation magnetization in a magnetic field of 3000 Oe of not less than 60 emu/g.

6. The developer system according to claim 2, wherein said resin coating material comprises electrically conductive powder.

7. The developer system according to claim 6, wherein said electrically conductive powder has an average particle size of not greater than 1 μm.

8. The developer system according to claim 6, wherein said electrically conductive powder comprises at least one member selected from the group consisting of metal powder, carbon black and metal oxide powder.

9. The developer system according to claim 1, wherein the proportion of said second toner is from 3 to 20 parts by weight per 1 part by weight of said second carrier.

10. The developer system according to claim 1, wherein the second carrier of said second developer has a resin coat which comprises the same kinds of materials as used for the resin coat of the first carrier previously contained in the developing unit, but has a different composition from the first carrier.

11. A developing method comprising:

developing a latent image on a latent image holding member using a developing unit containing a two-component developer comprising a toner and a carrier while replenishing the developer with a developer for replenishment, wherein said developer for replenishment comprises a carrier and from 1 to 30 parts by weight of a toner per 1 part by weight of said carrier, and wherein said developer for replenishment has an electrical resistance substantially equal to that of the carrier previously contained in the developing unit, but said developer for replenishment gives a larger charge quantity to the toner as compared to the carrier previously contained in the developing unit.

12. The developing method according to claim 11, wherein said carrier is a coated carrier comprising magnetic particles coated with a resin coating material.

13. The developing method according to claim 12, wherein said magnetic particles have an average particle size of from 10 to 50 $\mu$m.

14. The developing method according to claim 12, wherein said magnetic particles have a saturation magnetization in a magnetic field of 3000 Oe of not smaller than 50 emu/g.

15. The developing method according to claim 12, wherein said resin coating material contains electrically conductive powder.

16. The developing method according to claim 15, wherein said electrically conductive powder comprises at least one member selected from the group consisting of metal powder, carbon black and metal oxide powder.

17. The developing method according to claim 11, wherein the proportion of said toner is from 3 to 20 parts by weight per 1 part by weight of said carrier.

* * * * *